United States Patent [19]

Bascus

[11] 4,336,627

[45] Jun. 29, 1982

[54] WATER CONDITIONING SYSTEMS

[76] Inventor: Lionel D. Bascus, 2300 Finch Ave. W., Unit 22, Weston, Ontario, Canada

[21] Appl. No.: 150,990

[22] Filed: May 19, 1980

[51] Int. Cl.[3] ..... A47L 5/12

[52] U.S. Cl. ..... 15/321; 15/340; 180/53 R

[58] Field of Search ..... 15/321, 320, 340; 180/53 R, 53 A, 54 A; 192/3, 59

[56] References Cited

U.S. PATENT DOCUMENTS

| | | | |
|---|---|---|---|
| 4,069,540 | 1/1978 | Zamboni | 15/320 |
| 4,154;578 | 5/1979 | Bane | 15/320 |
| 4,158,248 | 6/1979 | Palmer | 15/321 |
| 4,207,649 | 6/1980 | Bates | 15/321 |
| 4,284,127 | 8/1981 | Collier | 15/321 |

*Primary Examiner*—Robert W. Jenkins

[57] ABSTRACT

The present invention relates to a system for conditioning and dispersing wash water which is particularly suited for mobile carpet cleaning. The system comprises a liquid cooled internal combustion engine operating a high pressure pump, a water supply tank feeding water to the high pressure pump, a pulse pump for injecting chemicals into the water, an immersion heat exchanger downstream of the high pressure pump and a tool, which can be in the form of a cleaning wand when used for carpet cleaning, from which the chemically treated and heated water is dispersed onto a surface to be cleaned.

11 Claims, 5 Drawing Figures

WATER CONDITIONING SYSTEMS

FIELD OF THE INVENTION

The present invention relates to a system for conditioning and dispersing wash water and which is particularly suitable for carpet cleaning although it may also be used for high pressure washing and the like.

BACKGROUND OF THE INVENTION

There are presently available, quite a number of systems which can be used for carpet cleaning, high pressure washing, etc. Furthermore, some of these systems are portable to the extent that they may be set up in a truck or van, for mobile use. However, the problem with these systems is that they require an experienced trained, operator to operate the system. Many of these systems, because of their complicated natures and arrangement of components are subject to breakdown which is not easily remedied and which requires technical skills on the part of the operator to repair the breakdown.

The system of the present invention which is used for conditioning and dispersing wash water suitable for use in carpet cleaning, high pressure washing, etc., is on the otherhand, one which can be operated by a person having very little experience. In addition, the components are arranged so as to reduce the likelihood of breakdowns in the system whereby, the operator requires little, if any technical skills.

The system itself, comprises a liquid cooled internal combustion engine operating a high pressure pump which is fed water from a water supply source, an immersion heat exchanger in which the water is heated, a pulse pump operated by pulses of the high pressure pump and injecting chemicals from a chemical tank into the water before it is dispersed from the system but after it has passed through the high pressure pump and the heat exchanger, a tool from which the chemically treated and heated water is dispersed onto a surface to be cleaned and a pressure regulator for regulating the pressure at which the water is dispersed from the tool.

The heat exchanger is located downstream of the high pressure pump so that the water passing through the high pressure pump is relatively cool, substantially increasing the life of the high pressure pump. Furthermore, the life of the heat exchanger is also extended due to the fact that the chemicals are injected into the system only after the water has passed through the heat exchanger. Therefore, the chemicals do not abrade the heat exchanger which is supplied with heated coolant from the engine to heat the water passing therethrough.

In the event that the system is made mobile and operated from a van or truck, the van engine is used to provide power to this system. When the system is used for high pressure washing, the tool mentioned above takes the form of a high pressure washing tool. However, when the system is used for carpet cleaning, the tool takes the form of a cleaning wand, and a blower which is also operated by the internal combustion engine is added to the system for recovering the water used to clean the carpet.

BRIEF DISCUSSION OF THE DRAWINGS

The above as well as other advantages and features of the present invention will be described in greater detail according to the preferred embodiments wherein, FIG. 1 is a schematic view showing a preferred set up for the system of the present invention;

DETAILED DESCRIPTION ACCORDING TO THE PREFERRED EMBODIMENTS OF THE PRESENT INVENTION

Figure 1:
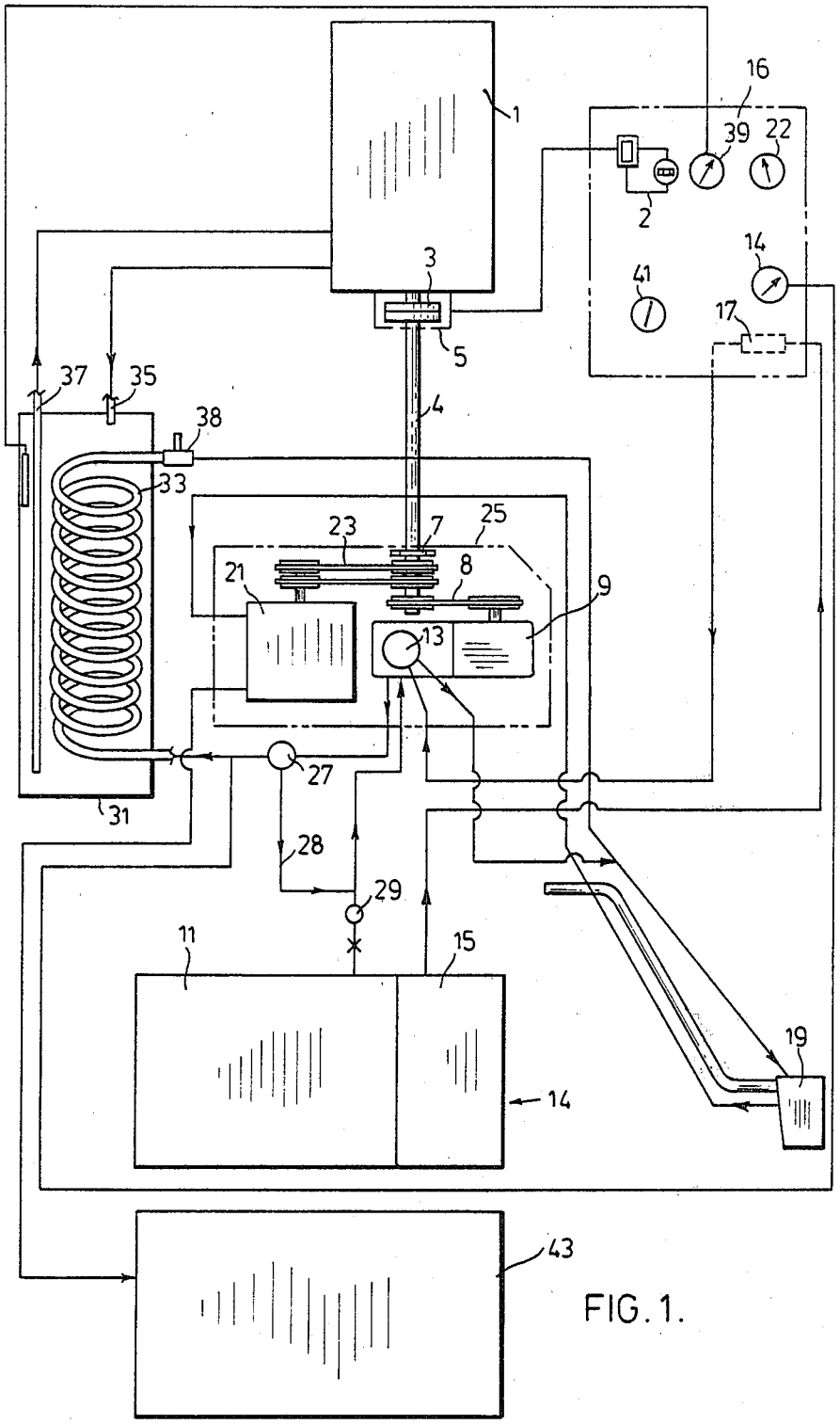

FIG. 1 shows in schematic form, a system particularly adapted for carpet cleaning using an internal combustion engine 1 driving a high pressure pump 9 and a blower 21 via connecting drive shaft 4. The blower which requires substantial driving power is hooked up to the drive shaft by a double pulley arrangement 23 which substantially eliminates all slippage between the drive shaft and the blower. The high pressure pump is on the other hand, connected to the drive shaft by a single pulley arrangement 8. The system shown in FIG. 1 is particularly suited for mobile operation from a van wherein engine 1 is in fact that van engine, and a separate electric clutch 3 may be turned off and on when desired at switch 2 provided on control panel 16. Furthermore, because the van engine sits somewhat higher than the high pressure pump and blower, drive shaft 4 is provided with forward and rearward tapered roller bearings 5 and 7 respectively which minimize torque on the drive shaft. The drive shaft itself is oil filled for lubrication and for increasing the life of the drive shaft.

The electric clutch is driven off two high power drive belts which are mechanically linked to the drive shaft and alternator. These are in turn, provided with double grooved pulleys to receive the drive belts of the electric clutch. Therefore, even with these adaptations, adjustments can be quickly and easily made to the electric clutch by adjusting the alternator in the standard manner.

High pressure pump 9 receives a supply of cold water from water supply tank 11. Although this supply of water may be drawn into the pump it is preferably gravity fed to the pumps as will be explained later in detail.

The pump then drives the water supply downstream through unloader valve 27 which when opened, permits the flow of water through an immersion heat exchanger 31. After the water has been heated, it is dispersed from the system onto a carpeted surface through cleaning wand 19. In accordance with conventional construction, high pressure pump 9 produces water pulses during its operation. However, unlike conventional construction, these pulses are put to use in operating a pulse pump 13 which draws a metered amount of chemicals from a chemical tank 15 through a metering device 17. The pulse pump then injects these chemicals into the water supply after it has passed through immersion heat exchanger 31.

After the cleaning operation is completed, the cleaning wand 19 is switched over to a vacuum cycle in which blower 21 produces a vacuum effect at the cleaning wand for recovering the water which has been used to clean the carpet. This recovered and now dirty water is stored in a recovery tank 43.

It will be noted from FIG. 1 that the high pressure pump and its associated pulse pump as well as the blower and the pulley mechanisms used to drive both the high pressure pump and the blower are contained within a housing 25 adapted to dampen the sound of these components. The housing which is better shown in FIG. 5 may be additionally provided with a *Blachford type lining 26. This housing significantly reduces the noise level of the system to about 87 decibels. The provision of the lining reduces the noise level by about a further 4 decibels.

*Trade Mark

Figure 3:
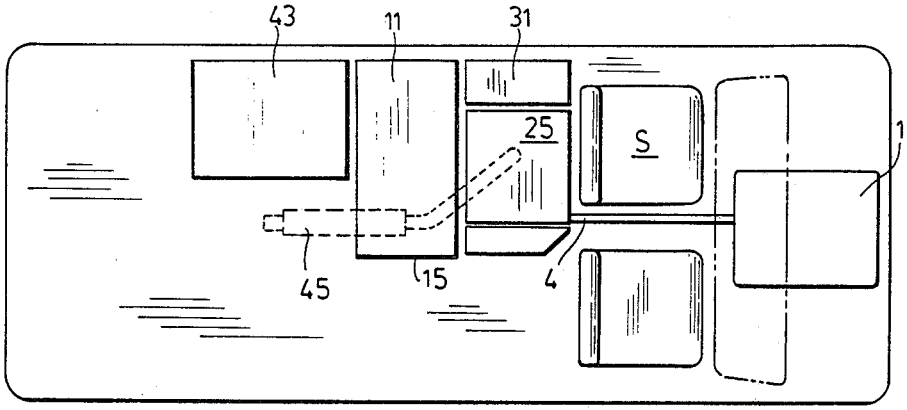
FIG. 3 is a top view of a van with the van roof removed showing the arrangement of system components in the van.
Figure 4:
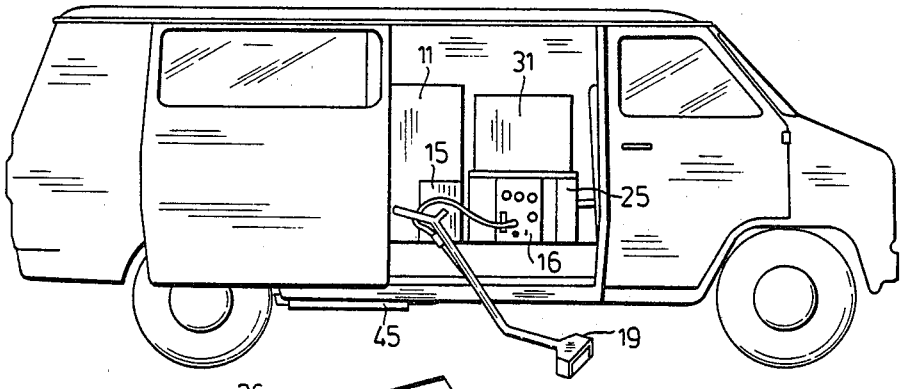
FIG. 4 is a side view of the van shown in FIG. 3.

When the components are arranged in the van, as shown in FIG. 3, they are positioned for optimal balance and weight distribution through the van while at the same time, permitting access to the system through either the rear doors of the van as is apparent from FIG. 3 or through the side doors of the van as is shown in FIG. 4.

Figure 5:
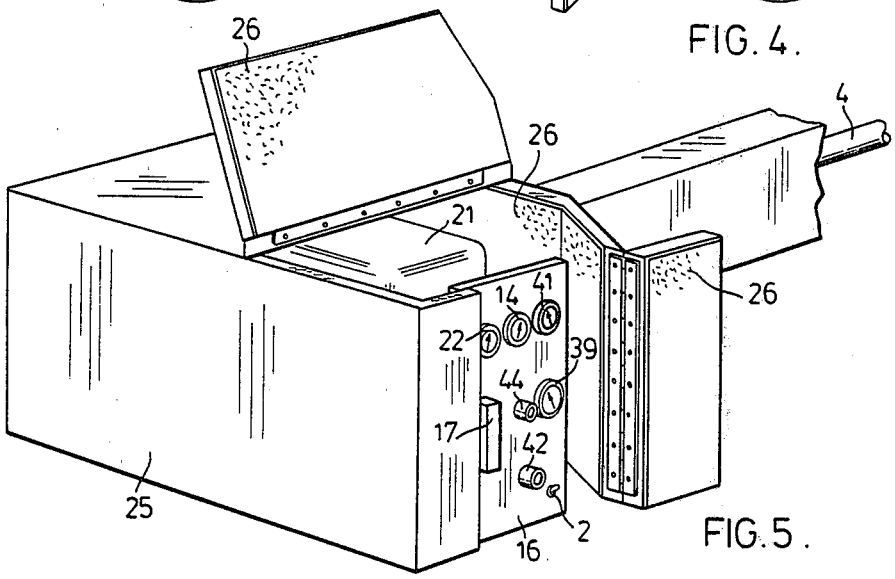
FIG. 5 is a perspective view looking down on some of the components secured within the van of FIGS. 3 and 4.

Housing 25 for the pump and blower, is located immediately behind the driver's seat S of the van. This housing extends slightly outwardly beyond the driver's seat whereby drive shaft 4 from the van engine 1 is connected directly into the housing. Furthermore, as shown in FIG. 5, housing 25 has a side door beside the exposed control panel and opening directly to the side door of the van as well as a top opening door permitting access to all of the components located within the housing for easy servicing.

Returning to FIGS. 3 and 4, an industrial silencer 45 is positioned beneath the van and acts as a muffler for the exhaust from blower 21. Therefore, while the blower noise itself is muffled by housing 25, the exhaust noise from the blower is muffled by the industrial silencer.

Heat exchanger 31 is located immediately adjacent housing 25. Located rearwardly of the heat exchanger and housing are the water supply and the chemical tanks 11 and 15. For the sake of compactness, both of these tanks are contained within a common housing 14 with chemical tank 15 being located in one of the lower corner regions of the housing and forming a minor portion of the overall tank. Recovery tank 43 is positioned behind the water supply and chemical tank over the left rear wheel of the van.

Water supply tank 11 is at a height such that water is generally gravity fed to high pressure pump 9. Only in the event of extremely low levels in the supply tank will the pump have to draw water from the supply tank. Furthermore, an outside water supply may be used as the source of water for the system. For example, if the van is being operated at an area provided with pressurized water, this water supply may be hooked directly up into control panel 16 at inlet 42 for supplying water to the high pressure pump. The water, after having passed through the system, flows out through outlet 44 on the control panel 16 to the cleaning wand.

Control panel 16 is also provided with on/off switch 2 controlling electric clutch 3 for rotating drive shaft 4 at the discretion of the operator. The control panel additionally includes pressure gauge 14 showing the pump pressure, vacuum gauge 22 which is run off blower 21, temperature gauge 39 recording the temperature in the heat exchanger, hour meter 41 and metering valve 17 which meters the amount of chemical injected via pulse pump 13 into the system. It should be noted that unlike some conventional systems, hour meter 41 only records the hours during which the system itself is operational and does not record the hours over which the van is being used without operation of the system.

The system is operated as follows: the operator drives the van to a particular location where carpets are to be cleaned. During the driving time, the system itself is not operational however, once on the job site, the operator actuates the system by simply turning on the switch to drive pump 9 and blower 21 via drive shaft 4. The pump is then fed cold water from tank 11 or an outside source, depending upon which water supply source is used. The cold water fed to the pump is then driven through the system lines to unloader valve 27 which is controlled at the cleaning wand to either permit continued flow through the system or to return the water to pump 9 through return line 28, i.e. when the cleaning wand is in use, unloader valve 27 is opened so that water continues to flow through the system to heat exchanger 31 and out of the wand. However, when the cleaning wand is not in use, unloader valve 27 is shut down and the water flows through the closed loop 28 back to the high pressure pump. The water will not return to the supply tank due to the provision on oneway check valve 29. With this arrangement, there is a continuous cooling flow of water through the pump, even when the wand is shutdown. However, even with this safety precaution, the wand should not be shut down for excessively long periods without dispersing some water from the system to introduce new cooling water to both the pump and the heat exchanger.

When the cleaning wand is in use, the water flows through unloader valve 27 and into coils 33 of heat exchanger 31. These coils are immersed in heated engine coolant which circulates between the heat exchanger and the engine via inlet 35 to the heat exchanger and outlet 37 from the heat exchanger back to the engine. The Water flowing through the heat exchanger may reach temperatures in excess of 180° F.

In the event that there is an excessive pressure buildup in the system, a pressure relief valve 28 is provided at the outlet of coil 33 from heat exchanger 31. This pressure relief valve is set to open at only pressures well in excess of those normal to the system i.e. 100 p.s.i. above normal system pressure, or when there is a serious malfunction which would otherwise damage the system. This pressure release valve when opened is set up to dump water from the system onto the road surface below the van.

Figure 2:
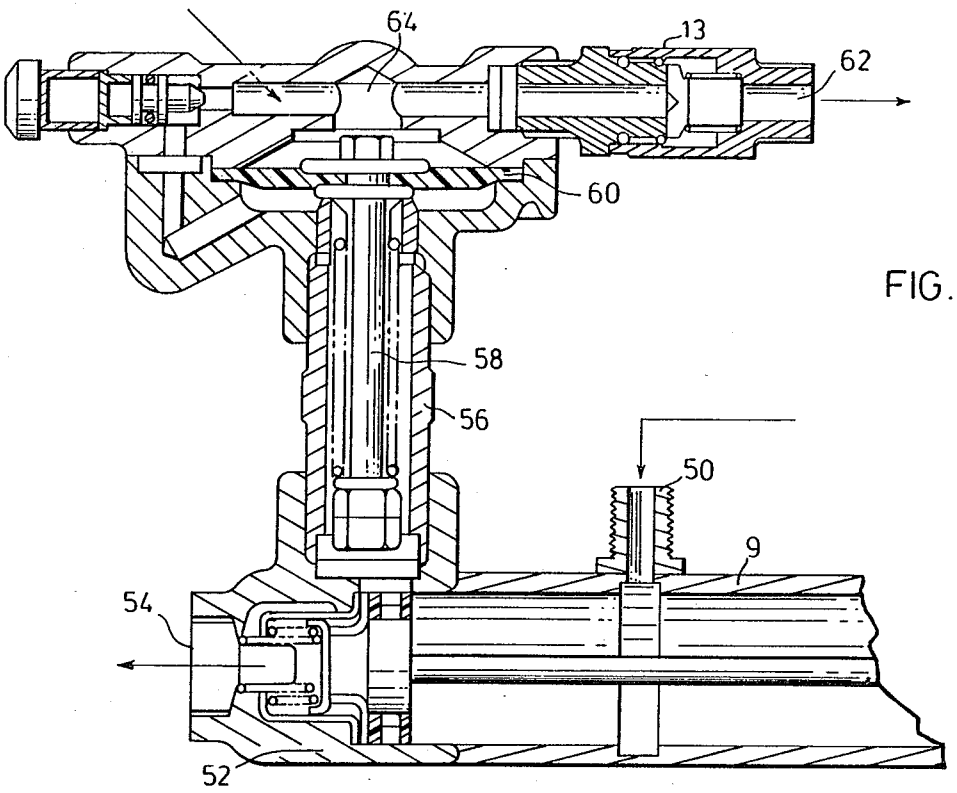
FIG. 2 is an enlarged sectional view of a portion of the high pressure pump of FIG. 1 and a pulse pump operated by the high pressure pump.

After the water has been heated, it flows out of the heat exchanger and to the cleaning wand 19. However, before it is dispersed from the cleaning wand, chemicals from chemical tank 15 are injected into the water by means of pulse pump 13, which is best seen in FIG. 2. This pulse pump is connected to the head 52 of pump 9 and is operated by pulses of the high pressure pump. The pulse pump itself, comprises a tubular body portion 56 having an internal pressure 58 in a fluid connection with pump head 52. A flexible diaphragm 60 seals the upper end of tubular passage 58 beneath pumping chamber 64.

The water is fed into the high pressure pump 9 via inlet 50 and is forced by the pumping action of the pump through outlet 54. This pumping action creates water pulses within the pumphead which drive water trapped within the pumphead upwardly into tubular passage 58 against the sealing surface of flexible diaphragm 60. As the water strikes the diaphragm, it forces the diaphragm to flex and collapse into pumping chamber 64 of pulse pump 13. This creates a pumping action within the pulse pump which draws chemical water through its inlet (not shown in the drawings) from chemical tank 15 and pumps the chemicals outwardly through outlet 62 into the heated water at a higher pressure than the water in the system. With the arrangement shown in FIG. 1, this injection is made into the lines leading to the cleaning wand.

The amount of chemical drawn from the chemical tank and injected into the system is determined by metering valve 17 which controls the chemical flow to the pulse pump.

In the event that the system of the present invention is used strictly as a water conditioning system for use in high pressure washing, cleaning wand 19 is replaced by a high pressure washing tool, having small orifices for emitting the chemically treated and heated water at high pressure onto a surface to be cleaned. In this arrangement as well as the carpet cleaning system arrangement, the pressure at the tool is the same as the pressure set at the unloader valve which in effect acts as a pressure regulator. With the high pressure washer, these orifices can be interchangeable with orifices of different sizes according to the type of work carried out. High pressure washing can be used for instance in car washing, in washing the walls of buildings, etc.

As is well shown in the drawings, and as described above, the system of the present invention is one which is easily operated and can be run with very little experience. Furthermore, because the components in the system are set up such that only cool, untreated water is run through the high pressure pump and into the heat exchanger, the pump is kept at low operating temperatures and there is very little, if any, caustic action within the pump and the heat exchanger. Furthermore, due to the provision of unloader valve 27 there is always a water flow through the pump which will not run dry, even in the event of a malfunction in the supply source. In addition, malfunctions are readily apparent at the control panel where the operator in charge of the cleaning tool can easily examine any one of the pressure, temperature or vacuum gauges and simply shut the system down by turning off the control switch which is accessibly located on the control panel.

Although various preferred embodiments of the invention have been described herein in detail, it will be appreciated by one skilled in the art, that variations may be made thereto, without departing from the spirit of the invention or the scope of the appended claims.

The embodiments of the invention in which an exclusive property or privilege is claimed are defined as follows:

1. In a mobile carpet cleaning system operated from a van having an internal combustion engine and a drive shaft from the van engine, said system comprising a high pressure pump operated off the drive shaft, a water supply tank in the van feeding water to said high pressure pump, an immersion heat exchanger downstream of said high pressure pump and having internal passages immersed in heated coolant from the van engine, said high pressure pump driving the water through the internal passages of the heat exchanger where it is heated by the heated coolant from the van engine; a chemical tank, a pulse pump operated by pulses of the high pressure pump and injecting chemicals from the chemical tank into the heated water downstream of the heat exchanger; a cleaning wand from which the chemically treated and heated water is dispersed onto a carpet to be cleaned, an unloader valve operated by said cleaning wand for regulating the pressure at which the water is dispersed from the cleaning wand and for bypassing water to the high pressure pump when the cleaning wand is inoperative, a blower driven off the drive shaft of the van engine for vacuuming the water from the carpet and a recovery tank for holding the vacuumed water.

2. A mobile carpet cleaning system as claimed in claim 1 wherein said unloader valve is positioned between said high pressure pump and said heat exchanger and is opened and closed with on/off switching respectively, of said cleaning wand, said unloader valve when opened, permitting water flow through said heat exchanger and out of said cleaning wand and when closed preventing water flow to and beyond said heat exchanger and unloading the water back to the feed of said high pressure pump.

3. A carpet cleaning system as claimed in claim 1 including a safety relief valve between said heat exchanger and said cleaning wand for relieving excessive pressure by releasing water from said system.

4. A carpet cleaning system as claimed in claim 1 wherein said drive shaft is oil-filled to increase life of the drive shaft and is provided with tapered roller bearings for reducing torque on the drive shaft.

5. A carpet cleaning system as claimed in claim 1 including a double pulley connection between said blower and said drive shaft for essentially eliminating slippage therebetween.

6. A carpet cleaning system as claimed in claim 1 wherein said water supply tank and said chemical tank are provided in a common housing.

7. A carpet cleaning system as claimed in claim 6 wherein the water supply tank, the chemical tank, the recovery tank, the high pressure pump, the blower and the heat exchanger are positioned for optimal weight distribution and balance in the van.

8. A carpet cleaning system as claimed in claim 1 including an industrial silencer for silencing exhaust from said blower.

9. A carpet cleaning system as claimed in claim 8 wherein said blower is enclosed within a sound dampening housing.

10. A carpet cleaning system as claimed in claim 9 wherein said sound dampening housing is lined with a fibrous sound dampening material.

11. In a mobile carpet cleaning system operated from a van having an internal combustion engine and a drive shaft from the van engine, said system comprising a high pressure pump operated off the drive shaft, a water supply tank in the van feeding water to said high pressure pump, an immersion heat exchanger downstream of said high pressure pump and having internal passages immersed in heated coolant from the van engine, said high pressure pump driving the water through the internal passages of the heat exchanger where it is heated by the heated coolant from the van engine; a chemical tank, a pulse pump operated by pulses of the high pressure pump and injecting chemicals from the chemical tank into the heated water downstream of the heat exchanger; a cleaning wand from which the chemically treated and heated water is dispersed onto a carpet to be cleaned, a pressure regulator operated by said cleaning wand for regulating the pressure at which the water is dispersed from the cleaning wand, a blower driven off the drive shaft of the van engine for vacuuming the water from the carpet and a recovery tank for holding the vacuumed water.

* * * * *